United States Patent [19]

Zabotin et al.

[11] Patent Number: 4,494,925

[45] Date of Patent: Jan. 22, 1985

[54] DEVICE FOR GAS JET CUTTING OF MATERIALS

[76] Inventors: Viktor G. Zabotin, Ulitsa XXII siezda 179, kv. 27; Alexandr I. Kosenko, Ulitsa Novo-Sadovaya 42, kv. 32; Sergei P. Kozlov, Ulitsa Zaporozhskaya 45, kv. 7; Alexandr N. Pervyshin, kvartal 15, 6, kv. 82; Viktor P. Lukachev, Volzhsky prospekt, 37, kv. 10, all of Kuibyshev; Vladimir A. Mikhailov, Ulitsa Mira 92, korpus 1, kv. 79, Moscow; Valery M. Buryakov, Ulitsa Onezhskaya 15b, kv. 27, Moscow; Roman D. Tokhunts, Izmailovsky bulvar, 67, korpus 1, kv. 5, Moscow; Vladimir S. Yakovlev, Ulitsa Marshala Novikova 6, korpus 2, kv. 56, Moscow, all of U.S.S.R.; Viktor Y. Levin, deceased, late of Kuibyshev, U.S.S.R.; by Sofia N. Levin, administratrix, Volzhsky prospekt, 37, kv. 58, Kuibyshev, U.S.S.R.

[21] Appl. No.: 408,224

[22] PCT Filed: Dec. 30, 1980

[86] PCT No.: PCT/SU80/00221

§ 371 Date: Aug. 16, 1982

§ 102(e) Date: Aug. 16, 1982

[87] PCT Pub. No.: WO82/02424

PCT Pub. Date: Jul. 22, 1982

[51] Int. Cl.[3] ..... F23Q 3/0

[52] U.S. Cl. ..... 431/158; 431/764; 431/352

[58] Field of Search ..... 431/158, 353, 264, 266, 431/352; 175/14; 266/48

[56] References Cited

U.S. PATENT DOCUMENTS

| | | | |
|---|---|---|---|
| 3,463,601 | 8/1969 | Childree | 431/158 |
| 3,666,393 | 5/1972 | Davies | 431/158 |

FOREIGN PATENT DOCUMENTS

| | | | |
|---|---|---|---|
| 595941 | 4/1934 | Fed. Rep. of Germany | 266/48 |
| 1393912 | 5/1975 | United Kingdom . | |
| 258206 | 2/1974 | U.S.S.R. . | |

*Primary Examiner*—Carroll B. Dority, Jr.

*Attorney, Agent, or Firm*—McAulay, Fields, Fisher, Goldstein & Nissen

[57] ABSTRACT

A device for gas jet cutting of materials, comprises a head (1), the case of which accommodates a primary and a secondary combustion chambers (3 and 4) interconnected by an axial passage (5), and injectors (9, 10, 11, 12) for supplying fuel and oxidizer into said combustion chambers (3 and 4). A nozzle (7) mating with the primary combustion chamber (3) ejects a cutting gas jet, and an igniter (8) is fitted to the secondary combustion chamber (4). The oxidizer supply injector (12) communicates with the primary combustion chamber (3) through the axial passage (5).

8 Claims, 2 Drawing Figures

DEVICE FOR GAS JET CUTTING OF MATERIALS

TECHNICAL FIELD

The present invention relates to gas burners, and, more specifically, to devices for gas jet cutting of materials.

BACKGROUND ART

The basic requirements to gas jet cutting equipment employed in rescue and recovery operations include independent functioning, light weight and small size providing for hand transportation, nontoxicity of fuel combustion products, high efficiency and quick starting.

Apart from that, efficient cutting of heterogeneous materials, such as those used for manufacture of airplane skin requires that the gas jet speed be sufficiently high, i.e., above the sonic speed, and that the gas temperature be of the order of +2500° C.

Known in the art is a device for gas jet cutting of materials (USSR Inventor's Certificate No. 258206, IPE E21C 21/00, Journal "Discoveries, Inventions, Industrial Designs and Trade Marks", 1973, No. 41) comprising a head, whose case accommodates a combustion chamber furnished with a cutting gas jet nozzle, and injectors for delivery of fuel and oxidizer into the combustion chamber.

That prior-art device is designed for working rock, for example, granite and quartz rock, by thermal treatment with a high-temperature and high-speed gas jet.

For setting the required parameters of the gas jet, the combustion chamber of the above-mentioned device is relatively large.

The device uses gasoline or kerosene and air as fuel and oxidizer, respectively.

The fuel-air mixture is ignited on the side of the nozzle by means of an external igniter.

The foregoing design of the device for gas jet cutting of materials does not permit the use thereof for rescue and recovery work in transport because of its heavy weight and large size.

In addition, the prior-art device cannot be efficiently employed for rescue and recovery operations because of its low performance, toxicity of combustion products and long period of preparation before use.

DISCLOSURE OF THE INVENTION

The present invention is essentially aimed at providing a device for gas jet cutting of materials, in which due to distribution of gas temperature in the head case it becomes possible to reduce the size thereof and to use the device for rescue and recovery operations in transport.

With this in view, the device for gas jet cutting of materials according to the invention includes a head, the case of which accommodates a combustion chamber having a nozzle for ejecting a cutting gas jet, and with injectors for feeding fuel and oxidizer into the combustion chamber, wherein the head incorporates a secondary combustion chamber fitted with fuel and oxidizer injectors and an igniter, and axially aligned inside the head with the primary combustion chamber, and wherein the combustion chambers are interconnected by a passage communicating with an injector serving for delivery of oxidizer into the primary combustion chamber.

The device for gas jet cutting of materials, according to the present invention, comprises a head, whose length is at least thrice less than that of the heads of prior-art devices. Thus, although the weight and size of the proposed device for gas jet cutting of materials are small, the parameters of the cutting gas jet are nevertheless high for efficient cutting of various materials.

The foregoing features provide for effective application of the gas jet cutting device in rescue and recovery work in transport.

BRIEF DESCRIPTION OF THE DRAWINGS

The invention will now be described in greater detail with reference to a preferred embodiment thereof taken in conjunction with the accompanying drawings, wherein.

DETAILED DISCLOSURE

Figure 1:
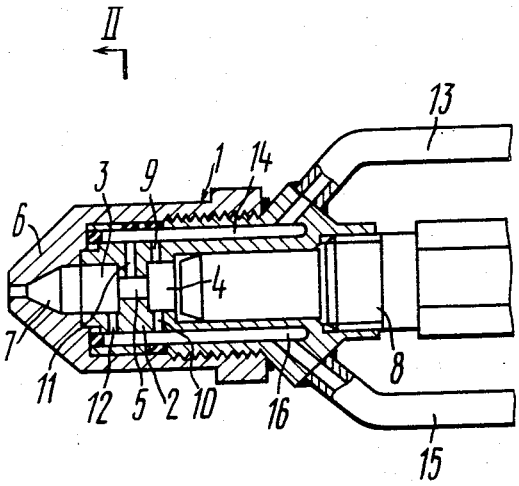
FIG. 1 is a general longitudinal cut-away view of a device for gas jet cutting of materials according to the invention.

Referring now to FIG. 1, a device for gas jet cutting of materials comprises a head 1 designed for producing a high-temperature high-speed gas jet serving to cut materials. The head 1 incorporates a cylindrical gas producer 2, whose interior constitutes a primary combustion chamber 3 and a secondary combustion chamber 4.

The primary and secondary combustion chambers 3 and 4 are axially aligned with the gas producer 2, and are interconnected by an axial passage 5.

An outer threaded surface of the gas producer 2 receives a copper end piece 6, whose interior forms a nozzle 7. A wider end of the taper-shaped nozzle 7 mates with the primary combustion chamber 3.

The end piece 6 and the gas producer 2 constitute the case of the head 1.

The case of the head 1 accommodates an electric spark igniter 8 axially aligned with the gas producer 2 and mating with the secondary combustion chamber 4. The electric spark igniter 8 is of any suitable known type.

For feeding fuel and oxidizer into the secondary combustion chamber 4, the gas producer 2 comprises jet injectors 9 and 10 arranged tangentially and communicating with the chamber 4.

Figure 2:
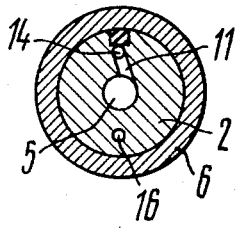
FIG. 2 is a section view of the device taken along line II—II of FIG. 1, according to the invention.

To supply oxidizer to the primary combustion chamber 3, the gas producer 2 (FIG. 2) includes a jet injector 11 connected to the axial passage 5 and set tangentially.

To supply fuel to the primary combustion chamber 3 (FIG. 1), the gas producer 2 comprises a tangentially jet set injector 12 communicating with the chamber 3.

The device according to the present invention uses oxygen and hydrogen as oxidizer and fuel, respectively. It is also possible to use some other fuel, for example, propane.

A fuel storage and supply system of the device according to the present invention is devised in the form of a back pack of any design known to those skilled in the art (not shown in the drawings), with the pack containing oxidizer and fuel bottles.

The oxidizer bottle (not shown in the drawings) is connected through a pipe 13, through a peripheral passage 14 machined in the gas producer 2, and through the injector 9 to the secondary combustion chamber 4.

Oxidizer supplied to the primary combustion chamber 3 flows through the peripheral passage 14 communicating with the combustion chamber 3 through the injector 11 and axial passage 5.

The fuel bottle (not shown in the drawing) by means of a pipe 15 and another peripheral passage 16 machined in the gas producer 2 and through the injectors 12 and 10, respectively communicates with the primary and secondary combustion chambers 3 and 4.

The gas producer 2 is a welded structure made of stainless steel.

The gas jet cutting device operates as follows. Oxygen and hydrogen contained in the back pack bottles (not shown in the drawing) are directed by the pipes 13 (FIG. 1) and 15 to the head 1 wherein they are mixed inside the primary and secondary combustion chambers 3 and 4.

The peripheral passages 14 and 16 feed oxygen and hydrogen to the jet injectors 9, 10, 11 and 12.

The ratio between the quantities of oxygen and hydrogen injected into the secondary combustion chamber 4 is adjusted properly for reliable ignition of the fuel mixture and for precluding high temperature inside the secondary combustion chamber 4 wherein the igniter 8 is to be protected against high temperature effects. The above ratio is controlled by an operating pressure in the peripheral passages 14 and 16, and by the diameters of the jet injectors 9 and 10.

The major amount of oxygen is delivered to the passage 5 through the injector 11 and to the primary combustion chamber 3.

The major amount of hydrogen is delivered to the primary combustion chamber 3 through the injector 12.

The fuel mixture is ignited inside the secondary combustion chamber 4 by a high-voltage spark. Combustion products going out from the chamber 4 are mixed with oxygen in the passage 5. The mixture of combustion products and oxygen flowing out of the passage 5 is mixed again inside the primary combustion chamber 3 with hydrogen and initiate burning in the primary combustion chamber 3.

The combustion products are accelerated to a high speed inside the nozzle 7. The high-temperature and high-speed gas jet ejected from the nozzle 7 is used for cutting materials.

For example, if the outlet section diameter of the nozzle 7 is selected to be equal to 2 mm, the temperature of the outlet gas jet is about +2500° C., and the speed thereof is of the order of 2000 m/s.

Since the gas jet cutting device incorporates the secondary combustion chamber 4, and oxidizer is injected in a tangential manner in the passage 5 (FIG. 2), with fuel injected in the same way into the combustion chamber 3 (FIG. 1), there are provisions for efficient film cooling of the foregoing chamber 3 and passage 5.

The gas jet cutting device of the invention increases the efficiency and the rates of rescue and recovery work in transport by virtue of its high gas jet cutting performance, nontoxicity of fuel combustion products and the small size and weight of the gas jet cutting device.

The device according to the invention shows high efficiency, dependability and simplicity in service.

The gas jet cutting device of the present invention serves for cutting metals and alloys having high heat conduction, such aluminium and alloys thereof, copper, and for cutting other materials, such as glass, concrete, rock, and plastics, and is applicable in rescue and recovery operations performed on all type of transportation facilities, including air, sea and ground transport means. Besides, the foregoing device can advantageously be used in industry for cutting blanks of various materials, for repair work, for molds cleaning and for scrap cutting of structures, such as airplanes.

We claim:

1. A device for gas jet cutting, comprising:

a head;

a gas producer in said head;

said gas producer including primary and secondary combustion chambers axially aligned and interconnected by an axial passage;

a nozzle discharge passage in one end of said head and communicating with said primary combustion chamber;

an electric spark igniter axially aligned with said gas producer and communicating with said secondary combustion chamber;

first and second injectors in said gas producer communicating with said secondary combustion chamber for feeding fuel and oxidizer therein;

a third tangential jet injector in said gas producer connected to said axial passage to supply oxidizer to said primary combustion chamber; and a fourth tangential jet injector in said gas producer communicating with said primary combustion chamber for supplying fuel therein.

2. The device of claim 1, further including conduit means for supplying oxidizer from a source of supply thereof to said secondary combustion chamber and communicating with said first injector.

3. The device of claim 1, further including conduit means for supplying oxidizer to said primary combustion chamber from a source of supply thereof through said third jet injector and said axial passage.

4. The device of claim 1, further including conduit means for supplying fuel from a source of supply thereof to said primary and secondary chambers through said second and fourth injectors.

5. The device of claim 1, wherein said head includes an outer portion fitting on said gas producer.

6. The device of claim 2, further including conduit means for supplying oxidizer from a source of supply thereof to said secondary combustion chamber and communicating with said first injector.

7. The device of claim 6, further including conduit means for supplying fuel from a source of supply thereof to said primary and secondary chambers through said second and fourth injectors.

8. The device of claim 7, wherein said head includes an outer portion fitting on said gas producer.

* * * * *